US008225427B2

(12) United States Patent
Bevier

(10) Patent No.: US 8,225,427 B2
(45) **Date of Patent: *Jul. 24, 2012**

(54) GLOVE WITH GRIPPING SURFACE

(75) Inventor: Joseph J. Bevier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1054 days.

This patent is subject to a terminal disclaimer.

(21) Appl. No.: 12/043,817

(22) Filed: Mar. 6, 2008

(65) Prior Publication Data

US 2009/0139010 A1 Jun. 4, 2009

Related U.S. Application Data

(63) Continuation-in-part of application No. 11/948,706, filed on Nov. 30, 2007.

(51) Int. Cl.
*A41D 19/00* (2006.01)

(52) U.S. Cl. ..... 2/161.6

(58) Field of Classification Search ..... 2/16, 20, 2/161.1, 161.6, 168, 169
See application file for complete search history.

(56) References Cited

U.S. PATENT DOCUMENTS

| | | | | |
|---|---|---|---|---|
| 1,979,130 | A | 8/1932 | Wiley | |
| 3,404,409 | A * | 10/1968 | Tillotson et al. | 2/161.8 |
| 4,689,832 | A | 9/1987 | Mulvaney | |
| 4,881,276 | A | 11/1989 | Swan | |
| 5,117,509 | A | 6/1992 | Bowers | |
| 5,423,089 | A | 6/1995 | Chun et al. | |
| 5,500,956 | A | 3/1996 | Schulkin et al. | |
| 5,511,248 | A | 4/1996 | Widdemer | |
| 5,598,582 | A * | 2/1997 | Andrews et al. | 2/16 |
| 5,625,900 | A | 5/1997 | Hayes | |
| 5,774,895 | A | 7/1998 | Baldwin | |
| 5,956,772 | A | 9/1999 | Widdemer | |
| 6,044,494 | A | 4/2000 | Kang | |
| 6,065,155 | A | 5/2000 | Sandusky | |
| 6,092,238 | A | 7/2000 | Fierabend, Jr. | |
| 6,099,936 | A | 8/2000 | Kashihara | |
| 6,209,138 | B1 | 4/2001 | Kang | |
| 6,408,442 | B1 | 6/2002 | Kang | |
| D494,713 | S | 8/2004 | Wheelington, II | |
| 6,912,731 | B2 | 7/2005 | Cass | |
| 6,928,658 | B2 * | 8/2005 | Taira et al. | 2/161.6 |
| D549,397 | S | 8/2007 | VanErmen | |
| 7,310,826 | B2 * | 12/2007 | Kishihara | 2/161.6 |
| 2003/0000005 | A1 | 1/2003 | Faulconer | |
| 2004/0025226 | A1 | 2/2004 | Jaeger | |
| 2006/0041991 | A1 * | 3/2006 | Kim Sim | 2/168 |
| 2006/0048268 | A1 * | 3/2006 | Loos | 2/161.6 |
| 2006/0168706 | A1 * | 8/2006 | Auger et al. | 2/161.6 |
| 2009/0139007 | A1 * | 6/2009 | Bevier | 2/161.1 |
| 2010/0192280 | A1 * | 8/2010 | McClard et al. | 2/161.8 |

OTHER PUBLICATIONS

Office Action issued in corresponding U.S. Appl. No. 11/948,706 mailed Dec. 2, 2010.

* cited by examiner

*Primary Examiner* — Katherine Moran
(74) *Attorney, Agent, or Firm* — Banner & Witcoff, Ltd.

(57) ABSTRACT

A glove with a base layer of a flexible material which extends along at least a palm-side portion of the glove which includes a palm area and inner sides of a plurality of finger stalls and a thumb stall. The glove also has a continuous second layer positioned on the palm-side portion and disposed on top of the base layer. The continuous second layer includes a plurality of contact areas and a contact surface. Also, the glove has a plurality of siping grooves which conduct liquid away from the contact surface and a plurality of channels which direct liquid away from the contact areas.

22 Claims, 14 Drawing Sheets

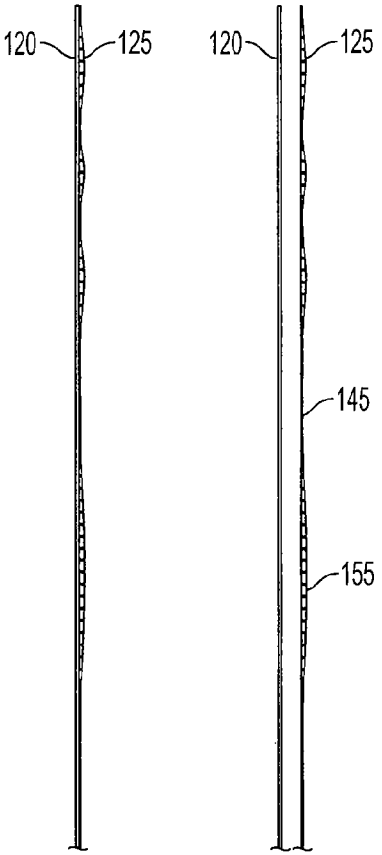
FIG. 9C
FIG. 9B
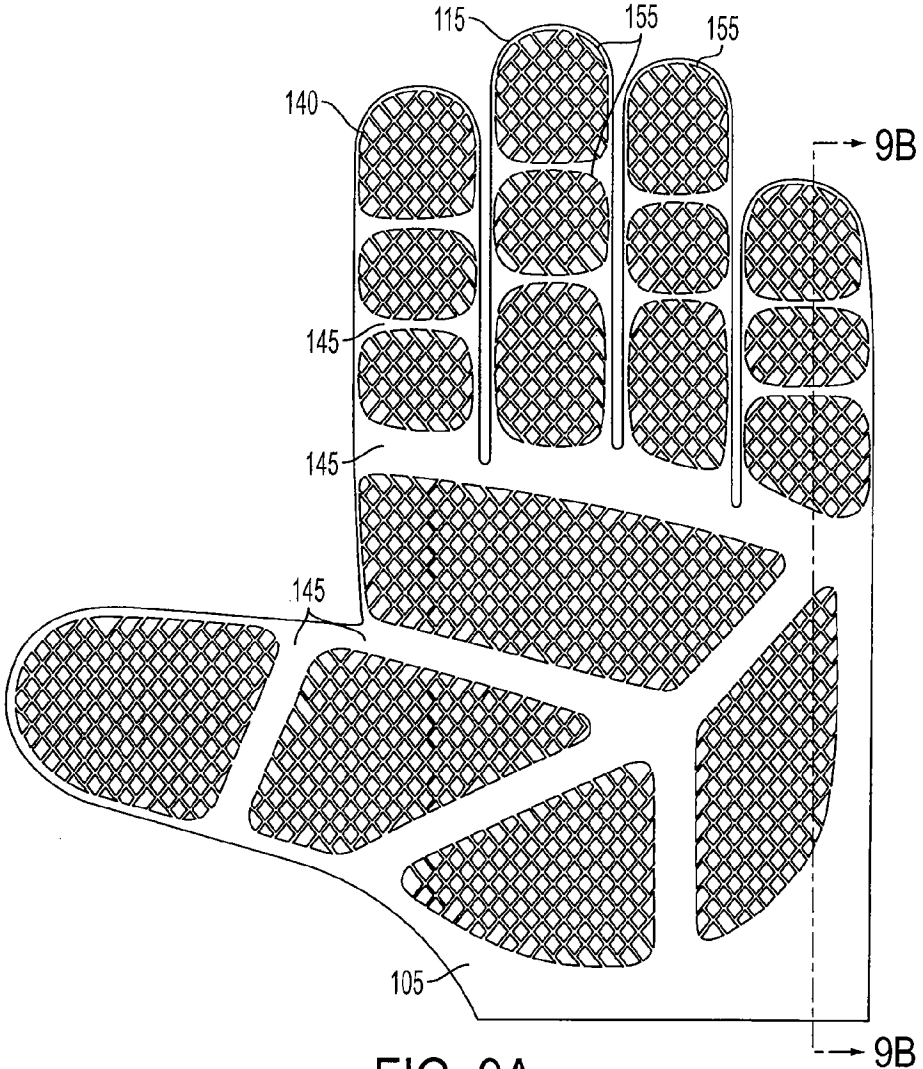
FIG. 9A

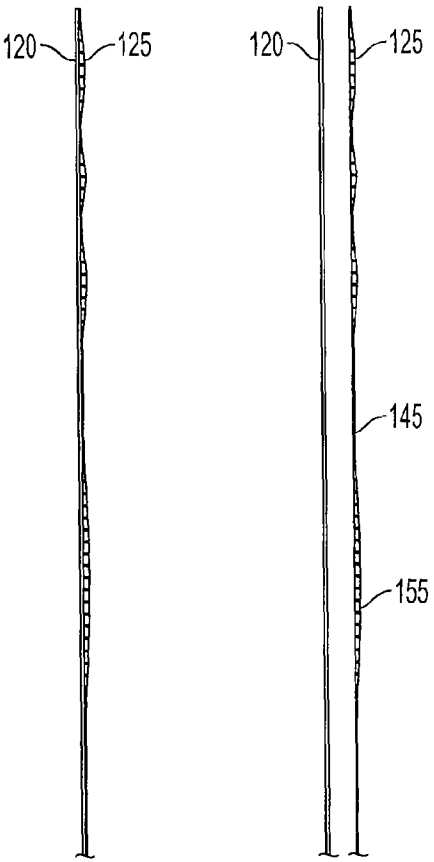
FIG. 10C
FIG. 10B
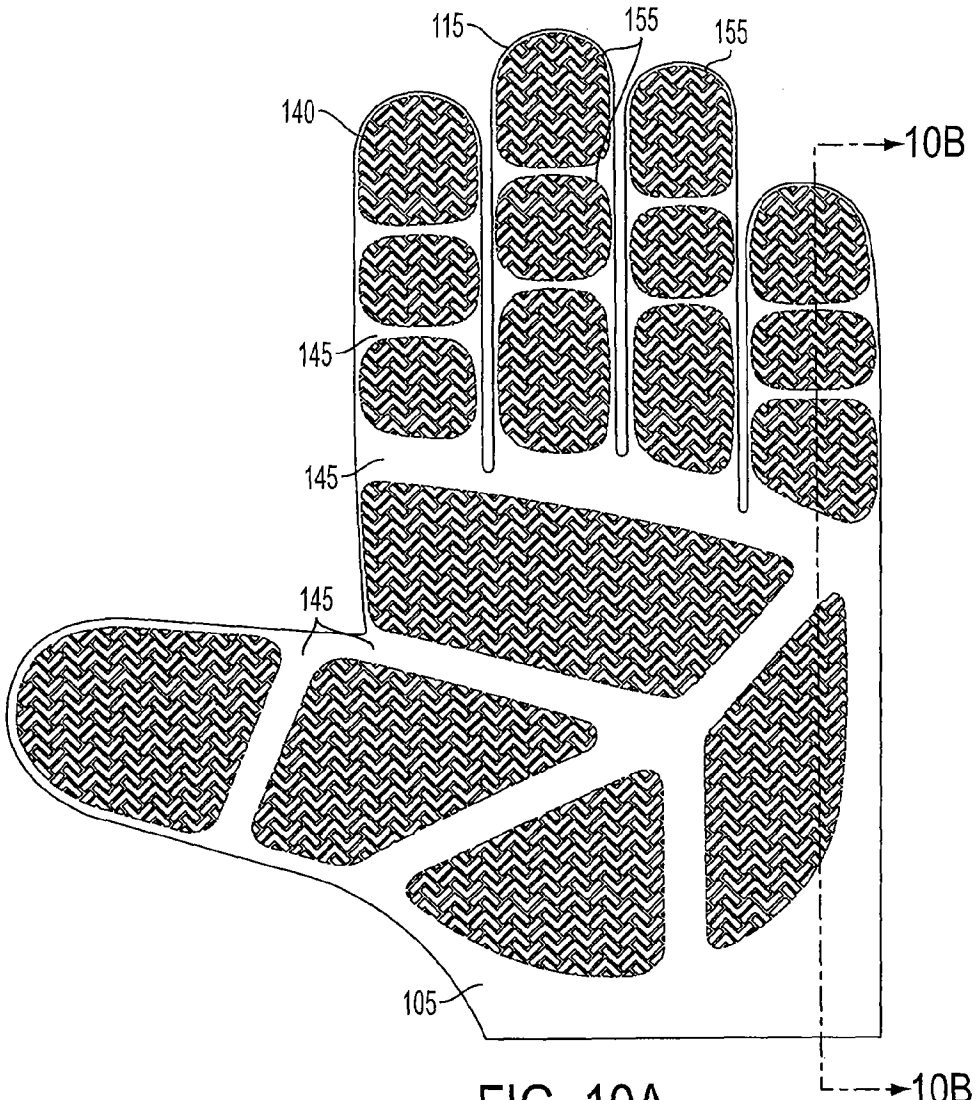
FIG. 10A

GLOVE WITH GRIPPING SURFACE

CROSS REFERENCE TO RELATED APPLICATIONS

This application is a continuation-in-part of U.S. patent application Ser. No. 11/948,706 entitled "Glove with Gripping Surface," filed Nov. 30, 2007 in the name of Joseph J. Bevier, the contents of which are entirely incorporated herein by reference.

FIELD OF THE INVENTION

Aspects of the present invention generally relate to apparel such as gloves, and more particularly to gloves that include an improved gripping surface even in wet conditions.

BACKGROUND

Gloves are worn for a variety of reasons. One such reason is that gloves may provide additional grip for handling an object. Such additional grip may be desirable in athletic activities. For example, in soccer a goal-keeper may wear gloves to provide additional grip when handling the soccer ball. Another example involves a receiver in football who may wear gloves to provide additional grip when catching the football. Some conventional gloves have surfaces on the palm area and finger stalls that improve the friction, or grip, of the glove. For example, in these gloves, the palm area and finger stalls may include tackified surfaces (see, e.g., U.S. Pat. No. 4,689,832 to Mulvaney) or surfaces with polyvinyl chloride (PVC) (see, e.g., U.S. Pat. No. 6,065,155 to Sandusky) to increase the gripping ability. However, wet conditions may affect the gripping ability of such gloves. For example, such gloves may be worn during athletic activities that take place outside. Exposure to the elements, such as precipitation (e.g. rain, sleet, snow, etc.), may reduce the friction or gripping ability of glove. Precipitation will stay on the palm and finger surfaces of the glove and act as a lubricant. Therefore, when the palm surface becomes slick, gripping ability is diminished.

Some conventional gloves have attempted to overcome the effects that moisture has on a glove's gripping ability. For example, U.S. Pat. No. 6,044,494 to Kang, entitled "Athletic Glove having Silicone-Printed Surface for Consistent Gripping Ability in Various Moisture Conditions," discloses a glove with a silicone sealant penetrated into the fibers of the glove so the glove retains a surface that is substantially level. In such gloves, silicone is typically applied to the glove's palm with a screen printing process, which is essentially a "two-dimensional" application of resin, plastic or rubber to the surface of the flat palm material in order to keep the surface substantially level. This flat surface creates a boundary layer that allows water to bead up or create a film that causes objects that the surface comes into contact with to slip or skid off (much like car tires hydroplaning on a wet road). Therefore, there exists a need for a glove that can provide improved gripping ability to the wearer even in wet conditions.

SUMMARY

The present invention generally relates to new and novel structures for apparel, such as gloves that provide improved gripping ability even in wet conditions. While the gloves may be referenced in regard to use during athletic activities, such reference is not meant to be limiting. Instead, the gloves may be used for any purpose in which it would be desirable to have increased gripping ability and especially in wet conditions that may affect a glove's gripping characteristics, including, for example, gardening gloves, work gloves, and the like.

Aspects of this invention relate to gloves that provide improved gripping abilities through features on a palm-side portion of the glove. These features increase the gripping ability of the glove and help remove liquid (e.g., water or other fluids) away from a palm-side portion of the glove so that the glove retains its improved gripping ability even when the glove is used in wet conditions, such as in the rain or other precipitation.

One aspect of this invention relates to gloves with a base layer of a flexible material that extends along at least a palm-side portion of the glove and includes a palm area and inner sides of a plurality of finger stalls and a thumb stall. The gloves also may include a second layer positioned on the palm-side portion and disposed on top of the base layer. The second layer includes a plurality of contact areas and a contact surface. Also, the gloves may have a plurality of siping grooves that conduct liquid away from the contact surface and a plurality of channels that direct liquid away from the contact areas.

Additional aspects of this invention relate to the siping grooves that are provided in the second layer and a capillary action of the siping grooves that draws liquid off the contact surface of the second layer and conducts the liquid into the depth of the siping grooves.

In additional aspects of the invention, the contact areas of the second layer are raised and each contact area may vary in thickness across its respective area. The contact surface is the top of the raised contact areas and the second layer is disposed on the base layer in a continuous or discontinuous manner so as to define a plurality of channels between the raised contact areas. If desired, one or more of the channels also may be provided within a raised contact area.

The above summary presents general aspects of the invention in order to provide a basic understanding of at least some of its aspects. The summary is not intended as an extensive overview of the invention. It is not intended to identify key or critical elements of the invention or to delineate the scope of the invention. The above summary merely presents some concepts of the invention in a general form as a prelude to the more detailed description provided below.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein:

FIG. 9A illustrates a palm side of a glove according to another aspect of the invention;

FIG. 9B illustrates a cross-sectional view of a portion of the glove as shown in FIG. 9A;

FIG. 9C illustrates an exploded view of the cross-sectional portion of the glove as shown in FIG. 9B;

FIG. 10A illustrates a palm side of another glove according to at least one aspect of the invention;

FIG. 10B illustrates a cross-sectional view of a portion of the glove as shown in FIG. 10A;

FIG. 10C illustrates an exploded view of the cross-sectional portion of a glove as shown in FIG. 10B;

DETAILED DESCRIPTION

In the following description of various example structures according to this invention, reference is made to the accompanying drawings, which form a part hereof, and in which are shown by way of illustration various example structures and systems in which aspects of the invention may be practiced. It is to be understood that other specific arrangements of parts, structures, example devices, systems, and the like may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or orientations during typical use (for example, when viewing a glove as worn on a user's hand). Nothing in this specification should be construed as requiring a specific three dimensional orientation of structures in order to fall within the scope of this invention.

Figure 1A:
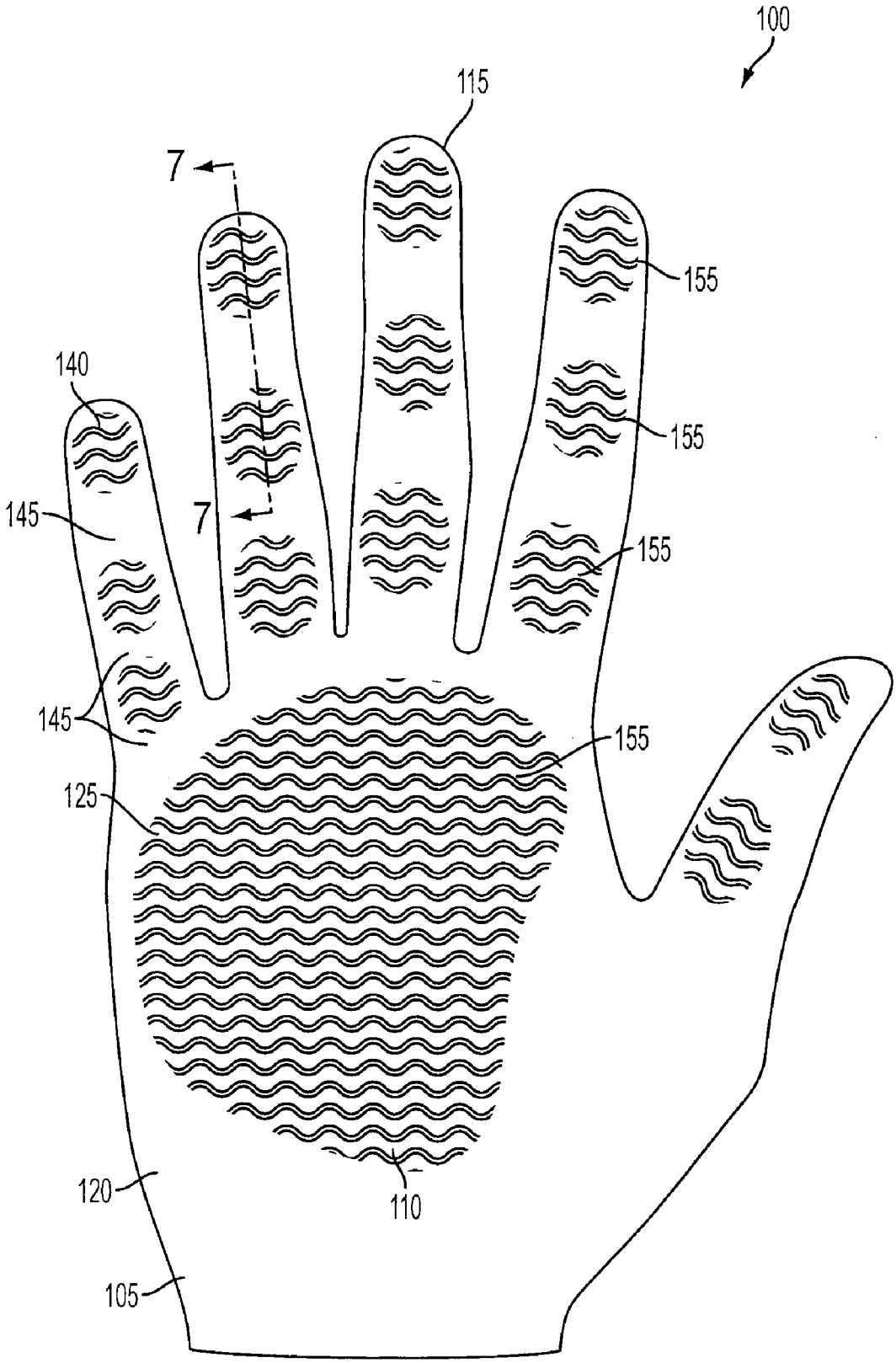
FIG. 1A illustrates a palm side of a glove according to at least one aspect of the invention.
Figure 1B:
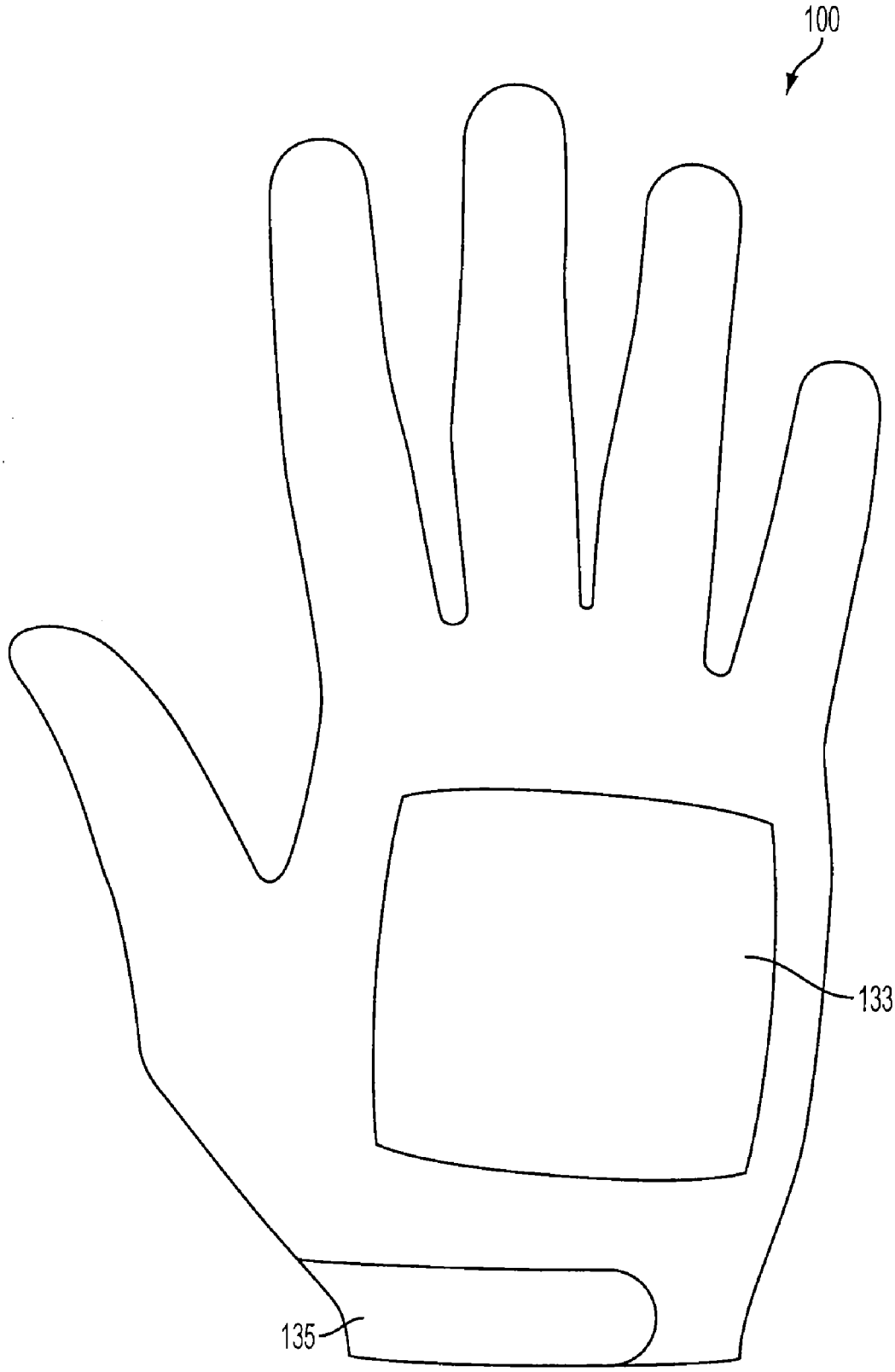
FIG. 1B illustrates a back side of the glove depicted in FIG. 1A.

An illustrative structure of a glove according to one aspect of the invention is shown at FIGS. 1A and 1B. In FIG. 1A, the palm side of the glove 100 is shown while in FIG. 1B the back side of the glove 100 is shown. As shown in the FIG. 1A, the palm side of the glove 100 may include a palm-side portion 105 that extends substantially over the face of the palm side of the glove 100. The palm-side portion 105 includes the palm area 110 and the inner sides of the fingers stalls 115 and the thumb stall.

In contrast to the shallow, printed texture of the silicone printed surfaces of conventional gloves, the glove structures according to aspects of the present invention provide a deeper and more crisply defined texture (more "three dimensional [3-D]" as compared to the "two dimensional [2-D]" structure of conventional printed gloves). An initial benefit of the "3-D" gloves is that the texture will last longer than the shallow printed texture of the "2-D" gloves because there is simply more material, and therefore, the material will not be quickly rubbed away thorough the abrasions resulting from contact with objects to be gripped (e.g. catching a football.)

In accordance with at least some aspects of this invention, the construction of such gloves may include multiple materials. For example, in the example structure shown in FIG. 1A, the majority of the glove (e.g. a base layer 120) may be constructed from a single flexible material, such as textiles, hydrophilic textiles, fabric, leather, synthetic leather, etc. In other example structures, the gloves may be constructed from a plurality of joined flexible parts. In the structure shown in FIGS. 1A and 1B, the glove's palm side and back side would be constructed of such material, and, in fact, could be constructed as a single unitary piece, although this is not necessary. A second layer 125 with a contact surface 130 (see FIGS. 6A and 6B) may be disposed on top of the base layer 120 at the palm side portion 105 of the glove. This second layer 125 may be formed either integrally with or alternatively adhered to the base layer 120 in a known manner. The second layer 125 may be comprised of materials such as thermoplastics (e.g., polyurethanes), thermoset plastics (e.g., silicones), other plastics, polyvinyl chloride (PVC), rubber, synthetic rubber, leather, synthetic leather, TPU, elastomers, or other polymeric materials, e.g., of the types used in bladders for balls, footwear soles, and the like. The second layer 125 may enhance the gripping ability of the glove 100. The second layer 125 may be a continuous layer that completely covers the palm side portion 105 of the glove 100. For example, in one example structure, the second layer 125 may be a thermoset plastic (e.g., silicone) that completely (or at least substantially) covers the palm side portion 105 of the glove.

In at least some example structures in accordance with this invention, the second layer 125 may have a height or thickness, up to the top of the contact surface 130, of up to 12 mm, and in some more specific examples, this height may be in the range of 0.1 to 10 mm, 0.75 to 8 mm, or even 1-6 mm thick. Therefore, as described above the material of the contact surface 130 will not be quickly rubbed away through the abrasions resulting from contact with objects to be gripped (e.g. catching a football.) Further, according to at least some examples of the invention, the second layer 125 may be a continuous layer that completely covers the palm side portion 105 of the glove 100, and therefore, it will further aid in preventing the material of the second layer 125 and its contact areas 130 from being quickly peeled or rubbed away.

Further, the above described glove structure may include other materials. For example, the back side of the glove 100 may include one or more patches 133 of LYCRA® or other breathable material that allows the skin to "breathe" and, in addition, allows moisture to be wicked away from the hand. Because the hand is encased in the glove 100, the temperature may be increased and exposure to air flow may be decreased, and therefore perspiration may occur. This is especially true if the glove 100 is being worn during athletic activities. Therefore, it may be beneficial, at least in some conditions of use, to allow the hand to breathe or for moisture to be wicked away by including the one or more patches 133 of breathable material, such as LYCRA®, or alternatively, by creating the entire back side of the glove 100, from a breathable material such as LYCRA®, etc. Providing a stretchable material for use as the back of the glove 100 (or at least portions thereof) also may help provide a tight but customizable or adjustable fit.

The glove 100 may include an adjustable strap 135 near an opening for inserting and removing the hand from the glove 100. The strap 135 may be used for tightening and loosening the glove 100 around the hand. Further, the strap 135 may include known means, such as snaps, buttons, hook-and-loop fasteners, elastic bands, etc., to attach to the glove 100 and to help secure the glove 100 on the wearer's hand. Any desired size adjustment and/or glove securing mechanisms may be provided, if desired, without departing from this invention.

According to one aspect of the invention, the second layer 125 may be constructed so that it includes (1) a series of 'siping' grooves 140 and (2) a series of channels 145. The 'siping' grooves 140 and the channels 145 enhance the gripping ability of the gloves by: (a) directing liquid (e.g. water) away from contact areas 155 of the second layer 125, (b) creating additional voids and edges in the second layer 125, (c) increasing the surface area of the second layer 125, (d) allowing less inhibited movement of the hand, (e) increasing the "feel" of the glove 100, and (f) creating multiple biting edges that mechanically interlock or otherwise interact with other rough surfaces such as the pebble grain of a football.

Siping Grooves

The siping grooves 140 remove liquid (e.g. water) from the contact surface 130 of the glove 100. In some example structures according to the invention, capillary action of the siping grooves 140 may suck the liquid off the contact surface 130 of the second layer 125 and conduct it into the depth of siping groove 140 and/or to the channels 145. Therefore, the contact surface 130 is kept substantially dry, even when exposed to wet conditions. A dry contact surface 130 is desirable because it provides better friction and grip. Therefore, removing liquid from the contact surface 130 is extremely beneficial in increasing a wearer's gripping ability.

Further, the siping grooves 140 can direct the collected liquid through the siping grooves 140 to the sides or edges of the glove and/or to the channels 145. The siping grooves 140 according to at least some example structures according to this invention accomplish removal of the liquid from the contact areas 155, because the grooves 140 are substantially continuous along their length. Further, the grooves 140 may be formed in patterns, or treads, so that the ends of the substantially continuous grooves 140 are directed toward the sides or edges of the gloves. Therefore, these patterns, or treads, remove the liquid (e.g. water) from the contact areas 155 by directing the liquid to the sides or edges of the glove. There, the liquid merely drips off the sides of the glove. Hence, these groove patterns, or treads, prevent the liquid from accumulating at the contact areas 155 of the glove 100, thereby increasing the friction characteristics of the glove 100.

As shown in FIG. 1A, one pattern in which the siping grooves 140 may be formed is a series of sinusoidal waves or lines. These sinusoidal waves are inherently curved and may extend across all, substantially all, or merely a portion of the palm-side portion 105 of the glove. Therefore, liquid would be directed through the curved sinusoidal siping grooves 140 to the sides or edges of the glove. The waves may be oriented in any direction. For example, the direction of the curves may be laterally across the palm-side portion 105 (as shown in FIG. 1A) or alternatively they may be oriented vertically along the palm side portion 105 or further alternatively at an angle askew to the lateral and vertical directions. The waves also may be arranged to curve somewhat as they extend along the glove (i.e., the central axis of the sine wave forming the grooves need not be a perfectly straight line).

The amount of friction associated with a particular orientation of the sinusoidal siping grooves 140 may be considered in determining the direction of the siping grooves 140. For example, the friction of the sinusoidal siping grooves 140 with respect to another object being handled (such as a ball being caught or thrown) may be more effective in a lateral direction as opposed to a vertical direction or at a particular askew angle. The dimensions of the siping grooves 140, such as the width, can be varied depending on desired purposes (for example, the efficiency of the discharge of water to the sides of the glove). However, the second layer 125 should still have an adequate amount of contact surface 130 to grip the object. The siping grooves 140 also may be arranged in different directions in selected portions of an individual glove, e.g., different orientations on the fingers v. the thumb v. the palm, for example, to maximize grip and contact and/or the presence of biting edges at different areas of the hand, optionally based on typical contact directions with the ball or other object at that area of the hand. If desired, a single siping groove 140 may vary in width over its length, and additionally, if desired, the width of the siping groove 140 may increase toward an edge of a contact area 155 such that the siping groove effectively turns (or "morphs") into a channel for conducting fluid at its end (channels of this type are described in more detail below).

Figure 2:
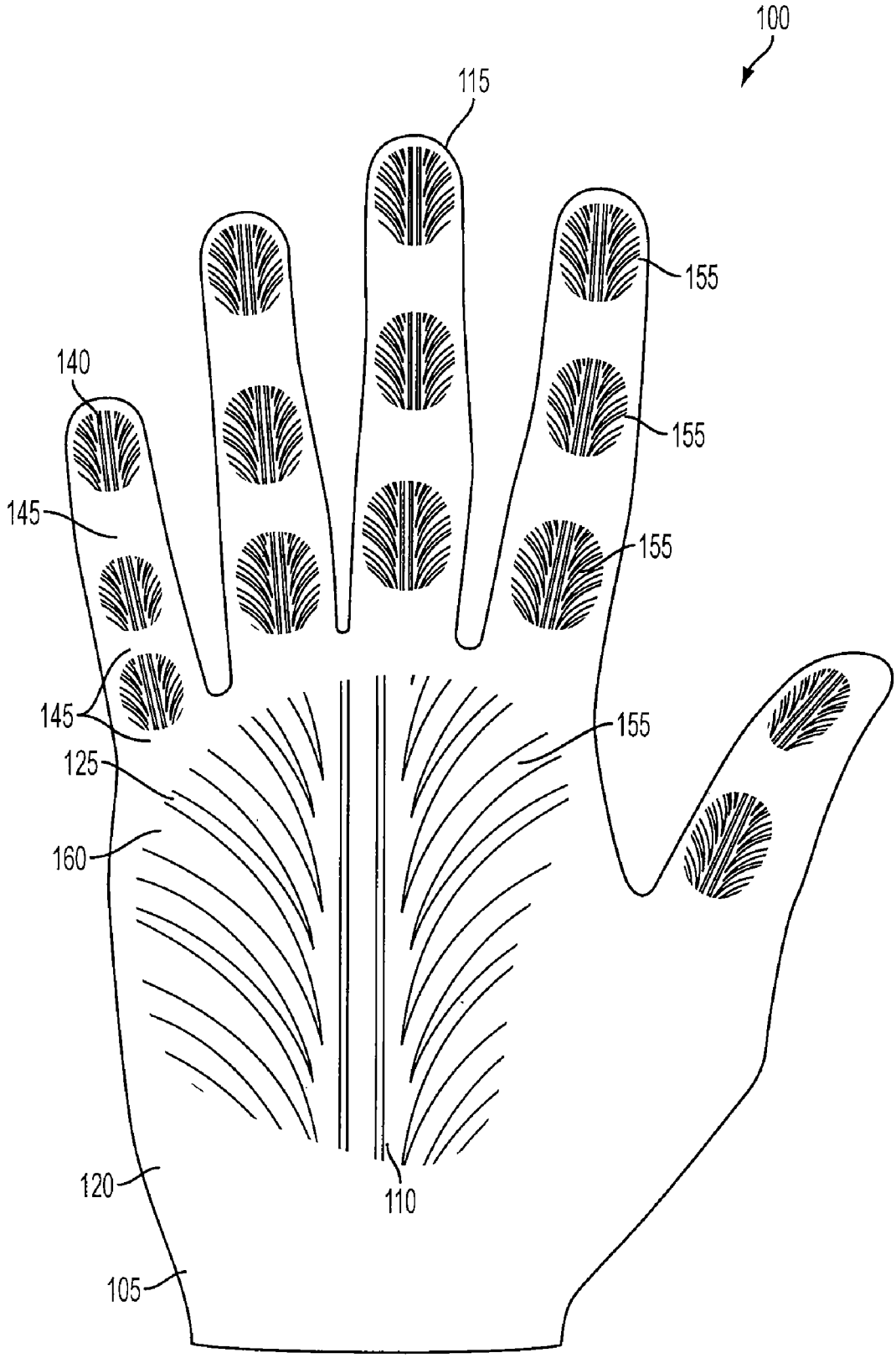
FIG. 2 illustrates a palm side of a glove according to a second aspect of the invention.

FIG. 2 illustrates another glove grip pattern in which the siping grooves 140 are formed in a pattern comprising rows or columns and slanted or curved lines. The siping grooves 140 may form generally "V" or "U" shapes that move liquid away from the contact areas 155 to the sides or edges of the glove 100 where the liquid would merely drip off. Also, the pattern includes siping grooves 140 in the shape of rows or columns that conduct water to the sides of the gloves including to a wrist portion or the finger tips of the glove 100. The pattern may include siping grooves 140 of differing widths (and, as noted above, at least some of the siping grooves 140 may expand in width so as to form a channel through which liquid moves to the edges of the contact areas 155 (without capillary action)). The dimensions of the siping grooves 140, such as the width, can be varied depending on desired purposes (for example, the efficiency of the discharge of water to the sides of the glove). However, the second layer 125 should still have an adequate amount of contact surface 130 to grip the object. The pattern may be oriented in any direction. For example, the direction of the pattern may be laterally across the palm-side portion 105 or alternatively oriented vertically along the palm side portion 105 or further alternatively at an angle askew to the lateral and vertical directions. The amount of friction associated with a particular orientation of the pattern may be considered in determining the direction of the siping grooves 140. For example, the friction of the pattern with respect to objects to be handled may be more effective in a lateral direction as opposed to a vertical direction or at a particular askew angle.

Figure 3:
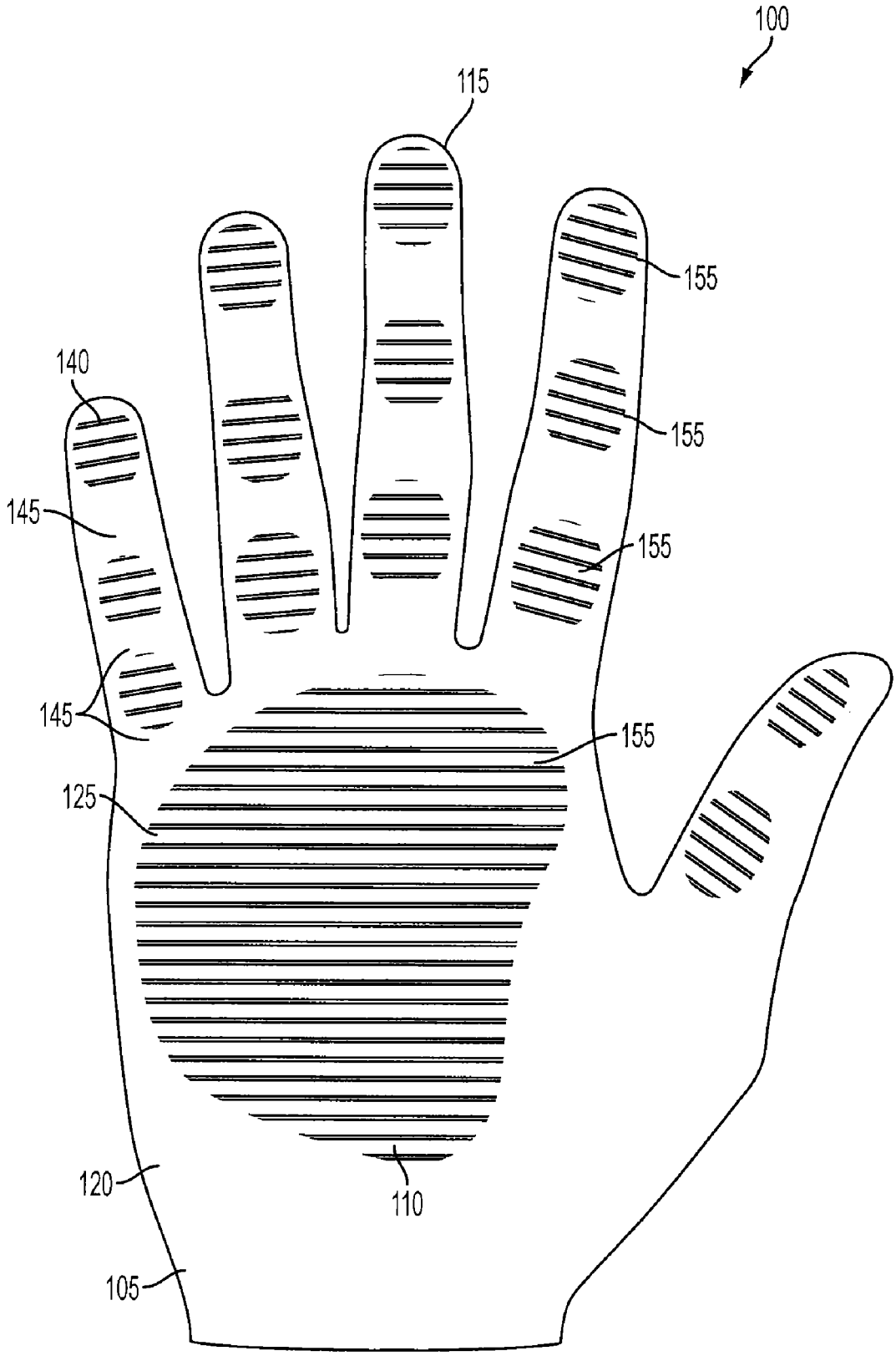
FIG. 3 illustrates a palm side of a glove according to a third aspect of the invention.
Figure 4:
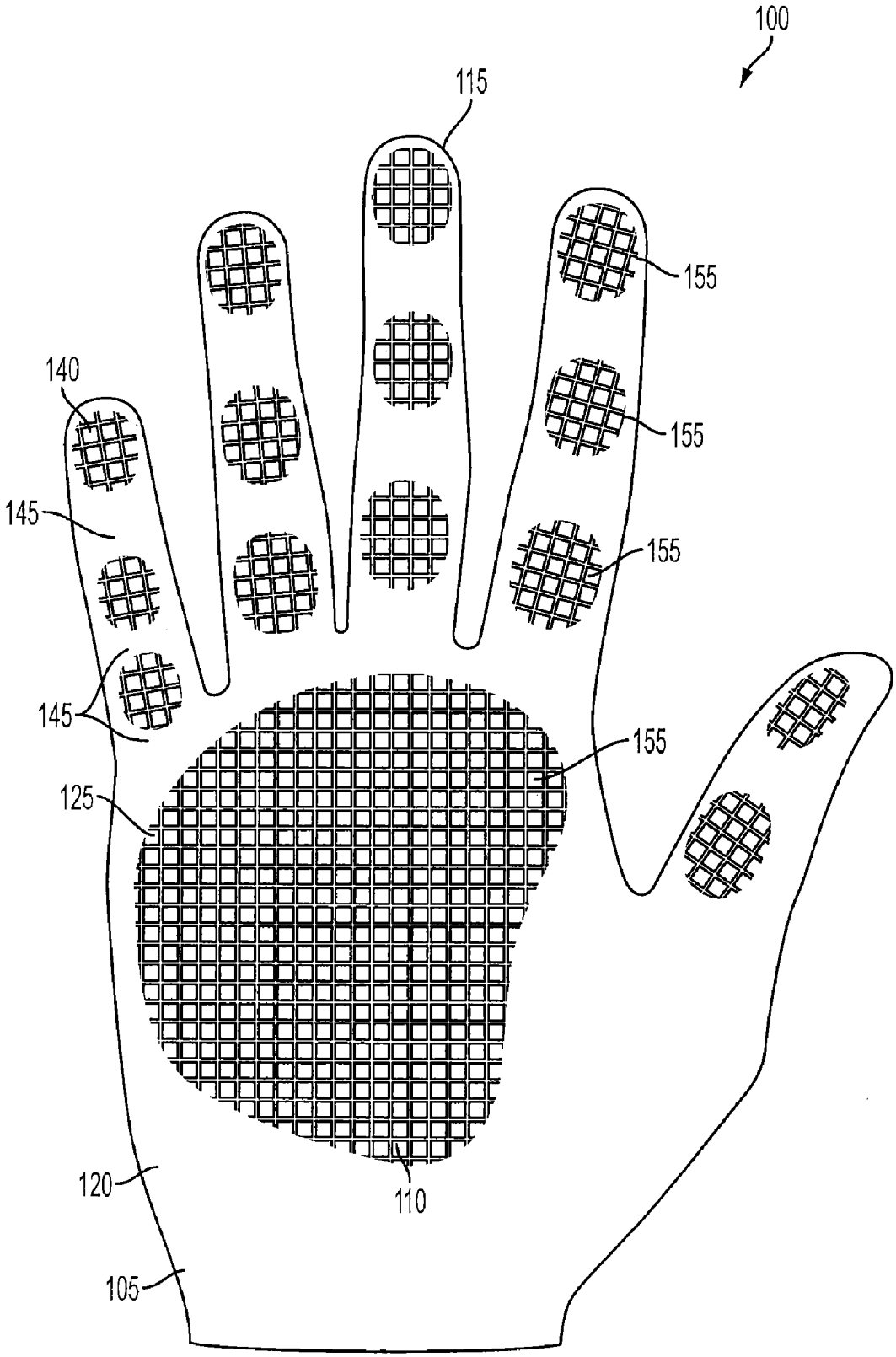
FIG. 4 illustrates a palm side of a glove according to a fourth aspect of the invention.
Figure 5A:
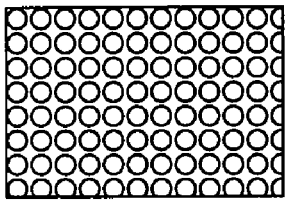
FIGS. 5A-G illustrates swatches of various other gripping element patterns according to this invention.
Figure 5B:
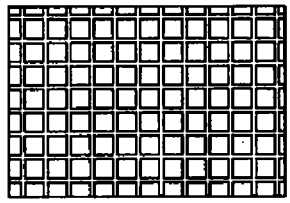
Figure 5C:
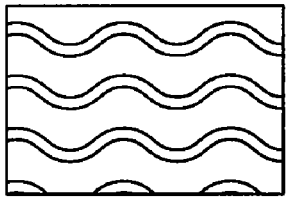
Figure 5D:
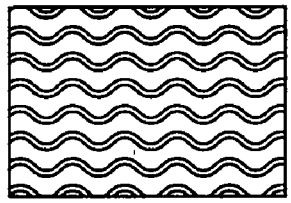
Figure 5E:
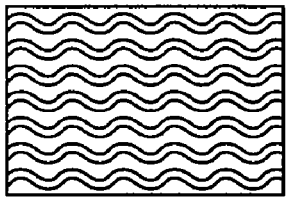
Figure 5F:
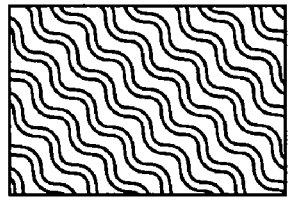
Figure 5G:
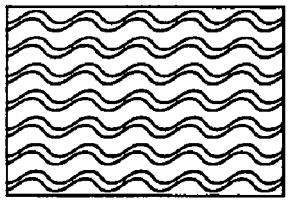

Other patterns of the siping grooves 140 may include straight lines as shown in FIG. 3 or grid-like structures as shown in FIG. 4. Additional examples of possible patterns are shown in FIGS. 5A-G. Further, these patterns may be combined or mixed on a single glove structure, e.g., depending on particular end uses of the glove. Also, many other patterns are possible including linear, non-linear, directional, non-directional, "squiggles," dots, geometric shapes, organic shapes, or the like. Further, the contact surface to siping (or other) groove area ratios that create more and less raised surface area may be implemented so that either the contact surface 130 is greater than the groove area or, conversely, the groove area (negative space) is greater than the contact area 130. The grip pattern of FIG. 5A provides certain advantages because of the round structure of the raised areas (which provide liquid wicking channel areas between the raised round portions). The round structure of the raised areas provides good gripping action in all directions because raised edges are provided in every direction, and therefore, a perpendicular raised edge is available to engage the ball (or other object) irrespective of the direction of contact between the glove and the ball (or other object). The raised round portions may be of any desired height without departing from this invention, including up to 12 mm high, and in some more specific examples, this height may be in the range of 0.1 to 10 mm, 0.75 to 8 mm, or even 1-6 mm. While any desired spacing between raised round portions also may be used without departing from this invention, preferably the edge of one raised portion will be spaced from the edges of the other raised portions by less than 8 mm, and in some more specific examples, these edge spacings may be spaced less than 6 mm, or even less than 4 mm, 2 mm, or even 1 mm. The round raised areas of FIG. 5A (as well as the various other patterns described herein) may be spaced around a glove structure in discrete and separated contact areas 155, for example, in the manner generally illustrated in FIG. 1A or in at least some of the areas illustrated in FIG. 1A.

Figure 11:
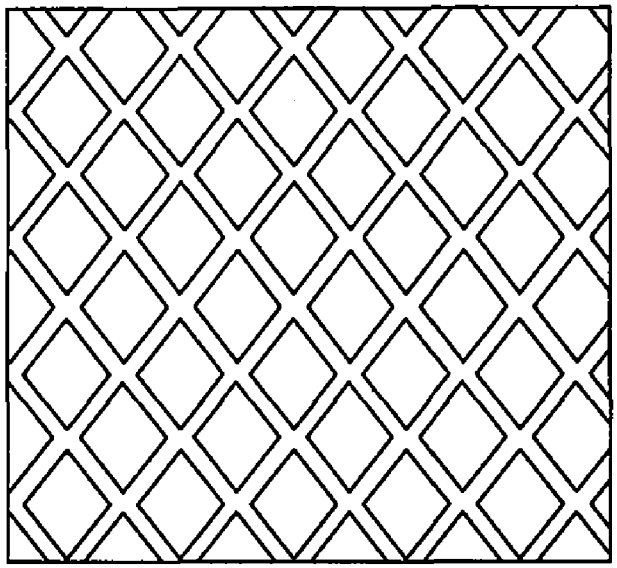
FIG. 11 illustrates a swatch of the pattern of the glove shown in FIG. 9A.

FIG. 9A illustrates another pattern in which the siping grooves 140 are formed by a plurality of diamond-shaped elements (FIG. 11 illustrates the pattern in an enlarged size). Just as described in reference to FIG. 5A the grip pattern of FIG. 9A provides certain advantages because of the diamond shaped structure of the raised areas (which provide liquid wicking channel areas between the raised diamond-shaped portions). The diamond shaped structure of the raised areas provides good gripping action in several directions because raised edges are provided in various different directions, and therefore, a perpendicular raised edge is likely available to engage the ball (or other object) irrespective of the direction of contact between the glove and the ball (or other object). The raised diamond-shaped portions may be of any desired height without departing from this invention, including up to 12 mm high, and in some more specific examples, this height may be in the range of 0.1 to 10 mm, 0.75 to 8 mm, or even 1-6 mm. While any desired spacing between raised diamond shaped portions also may be used without departing from this invention, preferably the edge of one raised portion will be spaced from the edges of the other raised portions by less than 8 mm, and in some more specific examples, these edge spacings may be spaced less than 6 mm, or even less than 4 mm, 2 mm, or 1 mm. Further, the pattern may be oriented in any direction. For example, the direction of the pattern may be laterally across the palm-side portion 105 or alternatively oriented vertically along the palm side portion 105 or further alternatively at an angle askew to the lateral and vertical direction. The amount of friction with respect to the object being handled associated with a particular orientation of the pattern may be considered in determining the direction of the siping grooves 140.

Figure 12:
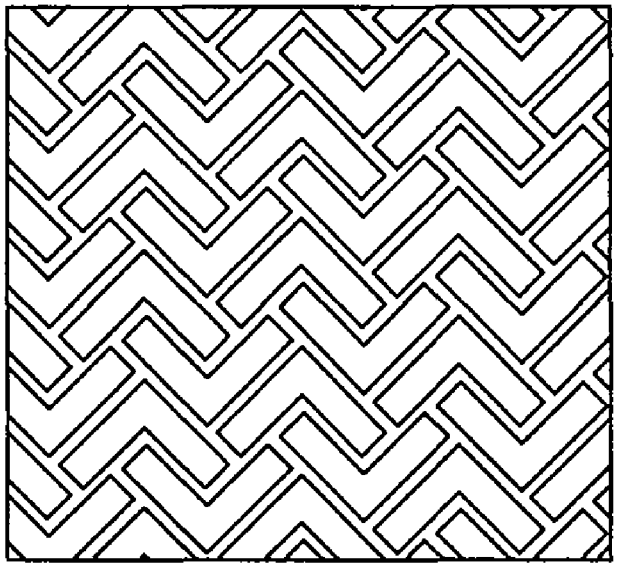
FIG. 12 illustrates a swatch of the pattern of the glove shown in FIG. 10A.

FIG. 10A illustrates another pattern in which the siping grooves 140 are formed by a plurality of angular (e.g., arrow head-shaped) elements (FIG. 12 illustrates the pattern in an enlarged size). As illustrated in FIG. 10A, the arrow shaped elements may be oriented so that they overlap, nest, and/or interlock with each other. Just as described in reference to FIGS. 5A and 9A, the grip pattern of FIG. 10A provides certain advantages because of the angular shaped structure of the raised areas (which provide liquid wicking channel areas between the raised angular shaped portions). The angular shaped structure of the raised areas provides good gripping action in several directions because raised edges are provided in various different directions, and therefore, a perpendicular raised edge is likely available to engage the ball (or other object) irrespective of the direction of contact between the glove and the ball (or other object). The raised angular shaped portions may be of any desired height without departing from this invention, including up to 12 mm high, and in some more specific examples, this height may be in the range of 0.1 to 10 mm, 0.75 to 8 mm, or even 1-6 mm. While any desired spacing between raised angular shaped portions also may be used without departing from this invention, preferably the edge of one raised portion will be spaced from the edges of the other raised portions by less than 8 mm, and in some more specific examples, these edge spacings may be spaced less than 6 mm, or even less than 4 mm, 2 mm, or 1 mm. Further, the pattern may be oriented in any direction. For example, the direction of the pattern may be laterally across the palm-side portion 105 or alternatively oriented vertically along the palm side portion 105 or further alternatively at an angle askew to the lateral and vertical direction. The amount of friction with respect to an object being handled associated with a particular orientation of the pattern may be considered in determining the direction of the siping grooves 140.

As stated above, the dimensions of the siping grooves 140 may vary based on the desired purpose. For example, in order to collect more water, in some glove structures, the siping grooves 140 may be somewhat wider. In other structures the siping grooves 140 may be narrower or slimmer, and in fact, in some structures, the siping grooves 140 may be almost microscopic. While the width may vary, in some glove structures in accordance with this invention, the siping groove width will range from 0.1 mm to 1.5 mm, and in some example structures, from 0.1 mm to 1 mm, or even from 0.15 mm to 0.75 mm.

Figure 6A:
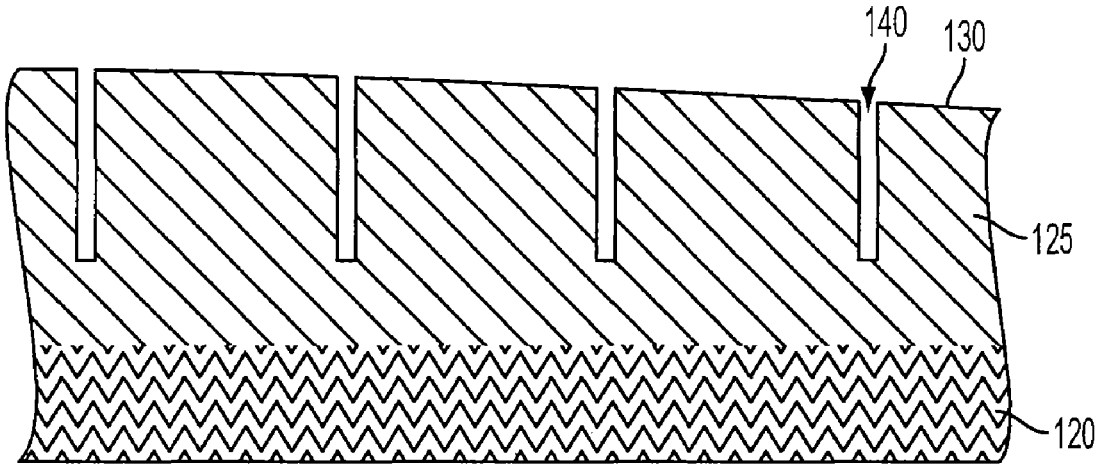
FIG. 6A illustrates an enlarged cross-sectional view of a portion of a glove according to one aspect of this invention.

The depth of the siping grooves 140 is also variable. As described above, the siping grooves 140 are disposed in the second layer 125. In one example structure, shown in FIG. 6A, the siping groove 140 does not extend all the way through the second layer 125 to meet the base layer 120. Therefore, as shown in FIG. 6A, the siping groove 140 is entirely within the second layer 125. In an alternative structure, shown in FIG. 6B, the depth of the siping grooves 140 is greater and extends all the way through the second layer 125 to the base layer 120. In this structure, the base layer 120 becomes the bottom of the siping groove 140. Also, in this structure, the materials from which both the base layer 120 and the second layer 125 are constructed can affect the siping groove's 140 ability to collect fluid. For example, hydrophobic or hydrophilic materials may be used singularly or in combination. The combination may create a push-pull system where water is repelled from the contact surface 130 and attracted into and moved out of the siping grooves 140. The depths of the siping grooves 140 may be varied within the grooves 140 provided in a single glove structure. In general, the depth of the siping grooves 140 may depend on the height of the second layer where the groove 140 is located, and the grooves 140 may be at least 0.25 mm deep, or even at least 0.5 mm deep.

Figure 6B:
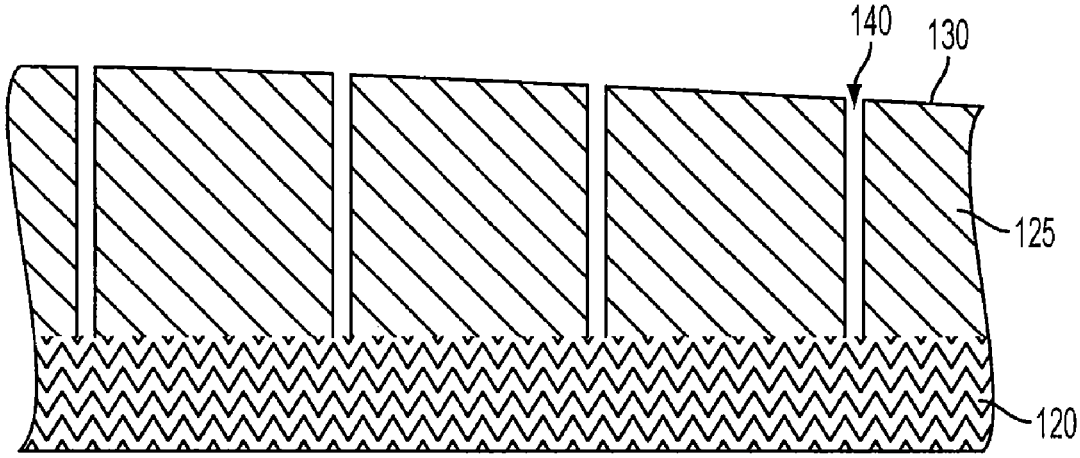
FIG. 6B illustrates an enlarged cross-sectional view of a portion of a glove according to another aspect of this invention.

As shown in the example structures of FIGS. 6A and 6B, the siping grooves 140 may be made deeper (into layer 125) than they are wide (across surface 130), and they may have a depth in at least some structures in accordance with this invention in the range of up to 12 mm, and in some more specific examples, in the range of 0.1 to 10 mm, 0.25 to 8 mm, or even 0.5 to 6 mm deep. The width of the grooves 140, in at least some example structures according to this invention, may be up to 8 mm, and in some more specific example structures, up to 6 mm, up to 4 mm, or even up to 2 mm wide. In at least some example structures in accordance with this invention, the siping grooves 140 (or at least some portions thereof) will be sized and shaped so as to induce capillary action in transferring water or other fluid from the contact surface 130 into the volume of the grooves 140.

In addition to removing liquid away from the contact surface 130 and contact areas 155 of the glove 100, the siping grooves 140 also increase the friction of the palm-side portion 105 by creating more voids and edges in the second layer 125. These additional edges can engage or "grab" more areas of the object to be gripped. Therefore, the additional edges and voids of the siping grooves 140 generally enhance the friction of the contact surface 130 compared to gloves that have a flat surface (i.e. a surface devoid of grooves 140, edges, etc.).

In addition to the siping grooves 140, the contact areas 155 may also contain grooves 160. As seen in FIG. 2, the contact area 155 located in the palm area 110 has several grooves 160. These grooves 160 direct liquid away from the contact areas 155 of the glove 100 toward the sides or edges of the glove 100 just as the siping grooves 140 do, but the grooves 160 can direct a larger quantity of liquid. Therefore, by directing larger amounts of liquid from the contact area, the contact area remains drier. As illustrated in FIG. 2, the grooves 160 may resemble the same patterns as the siping grooves 140, however this is not necessary.

Channels

Figure 7:
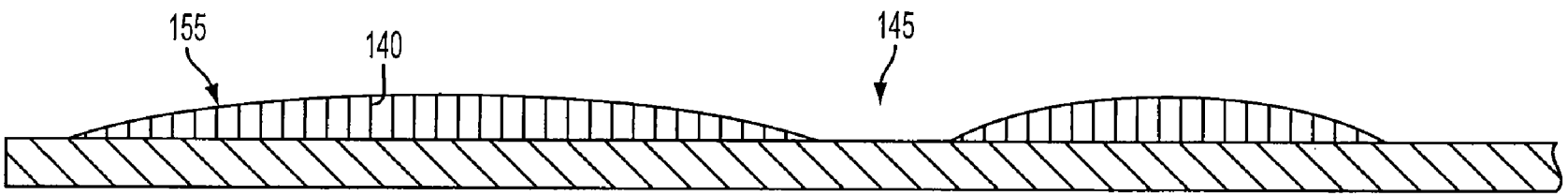
FIG. 7 illustrates an enlarged cross-sectional view of a portion of a glove according to another aspect of this invention.

In the above described structures, the second layer 125 may be disposed on the base layer 120 at the palm-side portion 105 so that contact areas 155 are raised areas, or lugs, and further, so that the contact areas 155 are created at different locations of the palm side. In some structures, the second layer 125 may be disposed on the base layer 120 in a discontinuous manner. One discontinuous manner may be provided by creating the second layer 125 as a plurality of discrete and separated "islands" to thereby produce raised contact areas 155 spaced apart from each other in particular patterns. For example, as illustrated in FIG. 1A, the second layer's raised contact areas 155 may be provided at a palm area 110 and at the inner sides of the finger stalls 115 (including the thumb) while areas between the raised contact areas 155 are not covered by the second layer 125. Inherently, this discontinuous positioning of the raised contact areas 155 on the base layer 120 will define areas of less height between said the various raised portions. For example, the particular positioning of the raised contact areas 155 in FIG. 1A defines areas of less height (i.e. channels 145) at the knuckle areas of the palm-side portion 105. The depth of the channels 145 between the raised contact areas 155 will depend on the heights of the raised contact areas 155 which define them. As illustrated in the cross sectional view of FIG. 7, the raised contact areas 155 may include gentle increasing and decreasing slopes along its area. Further, as illustrated in the cross sectional view of FIG. 7, ends of two raised contact areas 155 slope toward each other to provide the boundary or sides of the channel 145. However, the raised contact areas 155 may have other forms also. For example, the raised contact areas 155 may have a rectangular cross-section instead of the curved slope shown in FIG. 7. Therefore, the raised contact areas 155 would define a rectangular channel 145, which provide additional edges for increasing friction and/or engaging a ball or other object. The raised contact areas 155 may have other forms as well without departing from the scope of the invention.

Figure 8A:
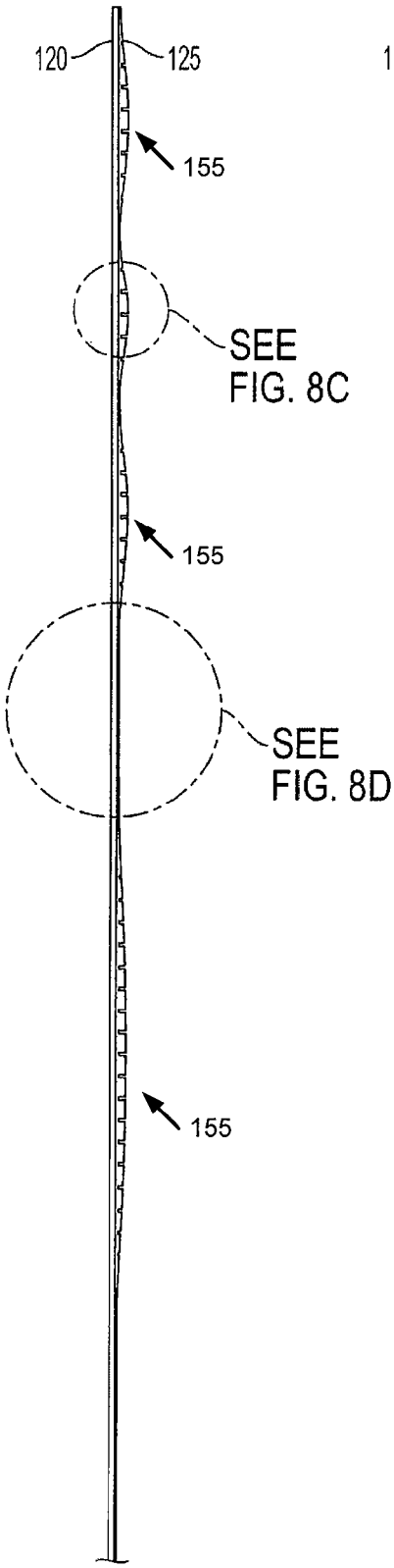
FIG. 8A illustrates a cross-sectional view of a portion of a glove according to one aspect of this invention.
Figure 8B:
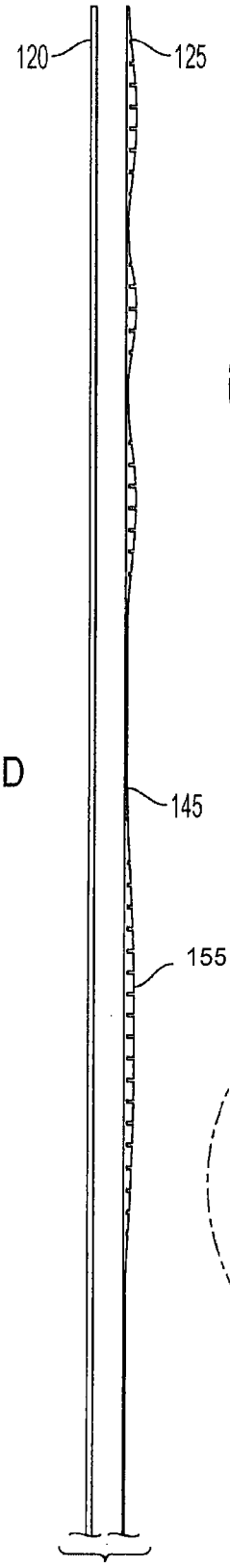
FIG. 8B illustrates an exploded view of the cross-sectional portion of a glove as shown in FIG. 8A.

In other glove structures, the second layer 125 may be a continuous layer disposed on the base layer 120. For example, as illustrated in FIGS. 8A and 8B, the second layer 125 may extend continuously, without breaks, across all or substantially all of the entire palm side portion 105 of a glove. Specifically, FIG. 8A illustrates a cross-sectional view of a portion of a glove, while FIG. 8B illustrates an exploded view of the cross-section shown in FIG. 8A. As best seen in FIG. 8B, the second layer 125 is, itself, a continuous layer (e.g., made from silicone or other materials as described above), which may be adhered to (or otherwise joined to) the base layer 120 (e.g., made from a textile material). If desired, at least 50% of the area of the palm side portion 105 of the glove may be covered by a continuous second layer 125, and if desired, at least 75%, at least 80%, or even at least 90% of the area of the palm side portion 105 of the glove will be covered by the continuous second layer 125.

As shown in FIGS. 8A and 8B, the continuous second layer 125 includes raised contact areas 155 and areas of less height 145 around the raised contact areas 155. Therefore, the continuous second layer 125 has a "plurality of islands" configuration similar to the structures described above. However, in contrast to the discontinuous nature of the second layer 125 of the above described structures, the second layer 125 may include a thin layer of material that interconnects at least some of the various contact area islands, and, therefore, the raised contact areas 155 extend upward from that level, as opposed to extending upward directly from the base layer 120.

Figure 8C:
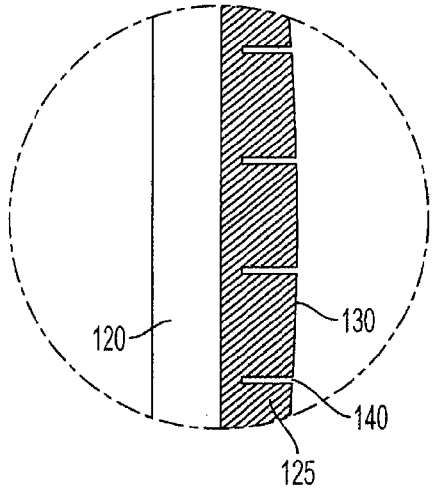
FIG. 8C illustrates an enlarged cross-sectional view of a portion of a glove as shown in FIG. 8A.
Figure 8D:
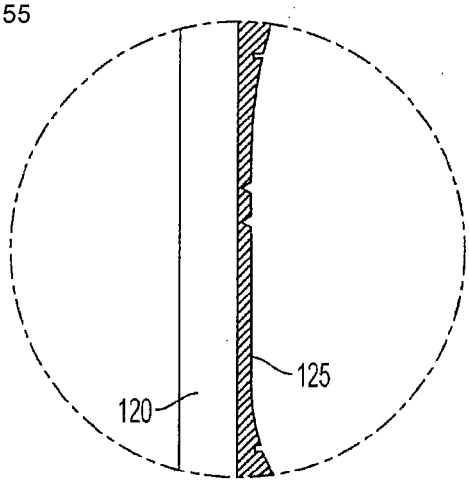
FIG. 8D illustrates an enlarged cross-sectional view of a portion of a glove as shown in FIG. 8A.

For example, FIG. 8C shows an enlarged portion of the raised contact area 155 shown in FIG. 8A. As can be seen in this figure, the siping grooves 140 do not extend down to the base layer 120. Further, FIG. 8D shows an enlarged portion of the area of less height, or channel, 145. As can be seen even at its thinnest portion, the second layer 125 still covers the base layer 125. Therefore, as demonstrated by these figures, according to at least some aspects of this invention, the second layer 125 may be a continuous layer. At its thinnest portion, such as the areas of less height or channels 145, the continuous second layer 125 may be only 0.1 or 0.2 mm thick. On the other hand, at its thickest portions, such as at the maximum height of the raised contact areas 155, the second layer 125 may have a thickness of at least 0.5 mm, at least 0.75 mm, at least 1 mm, at least 1.5 mm, or even at least 1.75 mm.

By providing the second layer 125 as a continuous layer, its wear resistance is increased. In other words, the second layer 125, including the raised contact areas 155, will not be quickly rubbed away or worn off through the abrasions resulting from contact with objects to be gripped (e.g. catching a football.) For example, the continuity of the second layer 125 can provide an integral and stable base structure for the raised contact portions 155 and, hence, the raised areas 155 will not as readily peel away or be worn away. Also, the raised areas 155 are likely to show signs of wear first, because they are the first areas that come in contact with the ball or other object. Because the palm area has to wear down the raised areas 155 first, it increases the time before excessive wear takes place on the non-raised areas. This substantially increases the life of the glove because it increases the time it takes to wear down the palm material, raised and non-raised areas.

In either case (i.e., a discontinuous second layer or a continuous second layer), the "plurality of islands" configuration would function in essentially the same manner. The channels 145 provide several benefits. First, the channels 145 may transport large quantities of water away from the palm-side portion 105 of the glove. As can be seen in the cross-sectional views of FIGS. 7, 8A, 8B, 9B, 9C, 10B, and 10C, the slopes of the raised contact areas 155 will direct water toward the channels 145. Similarly, the rectangular cross section would allow water to be collected into the channel 145. Therefore, water that comes into contact with the raised contact areas 155 will be immediately directed toward the channels 145 and/or down into the siping grooves 140. Then, the water collected in the channels 145 will be directed toward the sides of the glove. For example, as seen in FIGS. 9A and 10A, the channels 145 may extend into, around and through the palm area 110 in order to quickly and efficiently direct water away from the palm area. Thereby, the channels 145 prevent water accumulating at the raised contact areas 155 of the palm-side portion 105. In this way, the channels 145 and the siping grooves 140 provide a "two-fold" system for directing water away from both the raised contact areas 155 of the palm-side portion 105 and the contact surface 130. If desired, channels 145 also may be provided within the "islands" forming one or more of the raised contact areas 155, and at least some of the siping grooves 140 may dump their liquid into these channels. Also, as mentioned above, at least some of the siping grooves may be varied in thickness such that a narrow siping groove 140 (operating in a capillary manner) widens out or "morphs" into a wider liquid transferring channel.

Further, the dimensions of the channels 145 may be large enough to not only remove the water, but also to direct foreign matter, such as sand, mud, grass, etc., away from the palm-side portion 105.

A second benefit of the combination of the raised contact areas 155 and channels 145 is that they create additional voids and edges for contacting the object to be gripped. While the additional voids and edges created by the raised contact areas 155 and channels 145 are on a larger scale than the voids and edges created by the siping grooves 140, they serve the same purpose. In other words, the additional edges can engage or "grab" more areas of the object to be gripped, while the additional voids create different levels of surfaces that also improve the friction characteristics of the glove 100. Therefore, the raised contact areas 155 and channels 145 create additional friction to the palm-side surface 105 with respect to an object being handled.

Another benefit of the combination of raised contact areas 155 and channels 145 is that the total surface area of the glove is increased. The additional surface area provides more friction which adds additional grip to the glove. Further, the greater surface area helps the viscoelastic nature of the second layer to have more time to deflect over a greater area and thus to act to decelerate fast moving objects (e.g., when catching a pass, receiving a snap, etc.).

An additional benefit of the combination of raised contact areas 155 and channels 145 is that movement of the hand is less inhibited. In other words, the raised contact areas 155 and the channels 145 allow the glove to bend or flex more readily with the movement of the hand (e.g. curling of the fingers). While disposing a second layer 125 on base layer 120 provides additional gripping ability and improved durability, the additional thickness can detract from the flexibility of the glove. In general, the thicker the object becomes, the more resistant to bending the object becomes. Therefore, providing a relatively thick second layer 125 across the entire palm-side portion 105 would hinder the ability of the glove to flex or bend. However, by providing the raised contact areas 155 at particular contact portions and providing the channels 145 at particular bending portions, the thickness of the second layer 125 will have a reduced and/or minimal effect on the flexing or bending capabilities of the glove. For example, a configuration of a relatively thin continuous second layer 125 including raised contact areas 155 and areas of less height or channels 145, would allow for enhanced flexing and bending capabilities of the glove. Similarly, a discontinuous second layer 125 with raised contact areas 155 and areas of less height of channels 145 provided by the base layer 120 would also allow for enhanced flexing and bending capabilities of the glove. These arrangements of raised contact areas 155 and channels 145 allows the individual elements of the hand to move independently in the X, Y and Z axes because the raised contact areas 155 are decoupled or merely connected by a relatively thin portion of the continuous second layer 125. For example, as illustrated in FIG. 1A, the raised portions 155 may be provided at the finger stalls 115 and the palm area 110 while the channels 145 are provided at the knuckle areas and/or other bendable areas of the thumb, fingers, and/or palm portion. In this arrangement, the gripping ability of the glove is enhanced while not substantially detracting from the gloves ability to flex or bend. In another example shown in FIG. 9A, the raised contact areas 155 may be provided at the finger stalls 115 and the palm area 110 while the channels 145 are provided at the knuckle areas and/or other bendable areas of the fingers, thumb, and/or palm portion such as the palm area 110. Again, in this arrangement, the gripping ability of the glove is enhanced while not substantially detracting from the gloves ability to flex or bend.

As another example, if desired, the bending areas of the second layer 125 (e.g., at the knuckles or other bendable areas of the palm, fingers, and/or thumb) may be modified to include a groove or a further reduced thickness portion, or to otherwise form a line of weakness or a "pre-bending" line, to enhance the glove's ability to bend at predetermined locations.

Yet another benefit of the combination of raised contact areas 155 and channels 145 is that the feel of the glove is enhanced compared to a glove having a thicker surface across the entire palm-side portion 105 of the glove. In general, thick/stiff materials are not desirable in athletic gloves because they act to moderate pressure over a large area, which reduces the ability of the touch receptors of the human hand to give information about the touch and grip to the athlete's nervous system. The channels 145 of this glove allow the glove to include the thicker raised portions where they are most beneficial (e.g., at particular contact areas like the finger stalls or palm), while limiting the amount of the thickness at other areas of the glove. The thinness of the glove at these other areas allows it to articulate, stretch and compress with the movement of the hand. Further, pressure in the hand (e.g., palm) would be felt in small discrete areas giving better tactile sensitivity than a thick stiff material. Overall, the example structures according to this invention (with either a discontinuous second layer 125 or a relatively thin continuous second layer 125) provide gloves that will have a better "feel" as compared with a glove with thicker second layer 125 over the entire palm-side portion 105.

Figure 13:
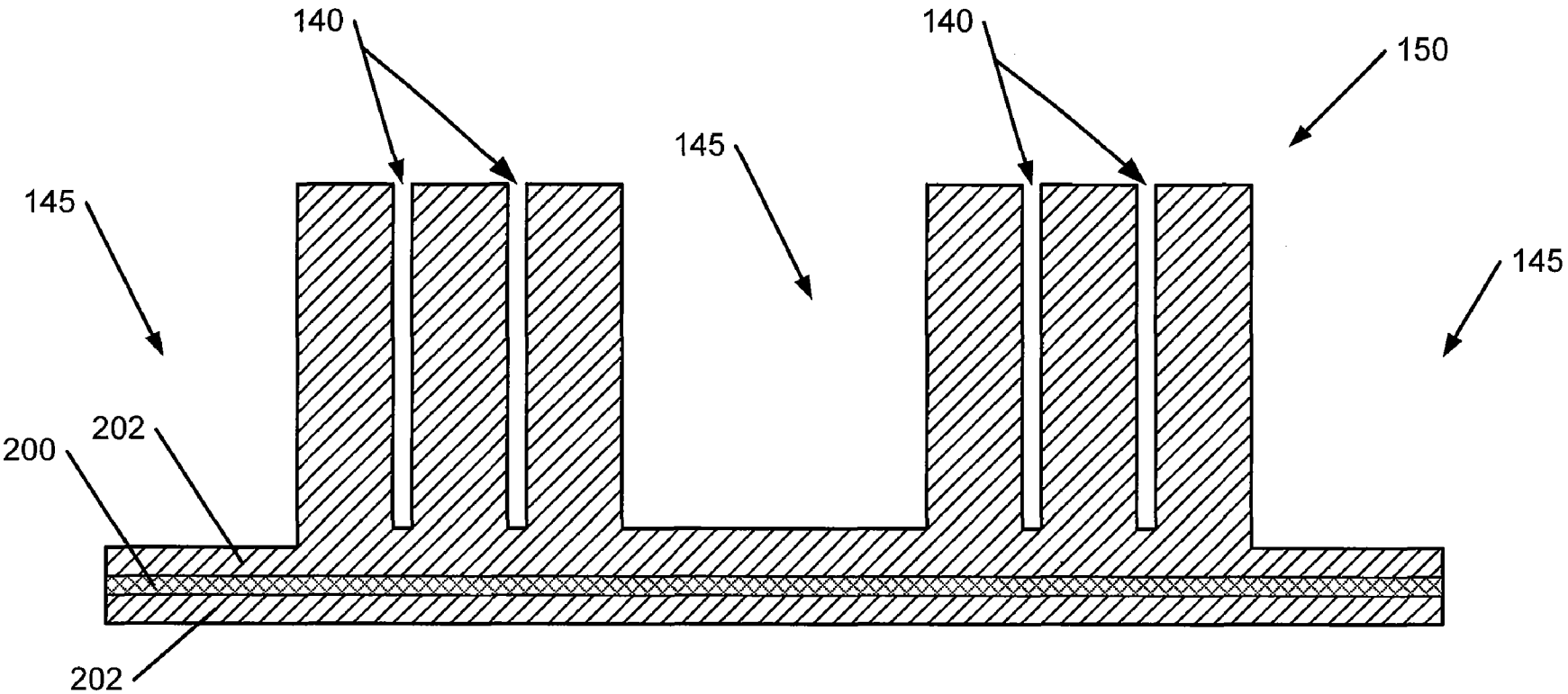
FIG. 13 illustrates a cross sectional view of a portion of a glove structure according to another aspect of this invention.

FIG. 13 illustrates another example material 150 that may be used in accordance with at least some examples of this invention. This material 150 includes an outer surface that functions like the second layer 125 described above and an inner surface (e.g., for directly contacting the wearer's hand). Like the structures described above, the material 150 (or at least the outer surface thereof) may be made of a viscoelastic material, like silicone or the other materials described above for the second layer 125. Also, like the second layers 125 described above, this outer surface of material 150 may be formed to include siping grooves 140 and channels 145, e.g., in the manner described above. In this example material structure 150, however, a textile material or other support material 200 is embedded within or surrounded by the viscoelastic material 202 making up the remainder of the material 150. Because the viscoelastic material 202 is somewhat susceptible to tearing (e.g., particularly when made very thin), the embedded textile or other support material 200 can provide a stable and durable base for the glove (e.g., to resist tearing). The embedded textile or other support material 200 also may provide improved breathability features to a glove (or other structure) made from this material. All or part of the glove can be formed from the material 150, especially all or some portions of the palm area of the glove. If desired, the glove may be structured so that the inner surface of the material 150 may directly contact the wearer's hand. Optionally, if desired, the inner surface may be treated or coated (or formed from another material) so as to reduce its tackiness (as compared to many viscoelastic materials) and to allow it to be more easily slipped over a wearer's hand.

Gloves or various parts thereof according to particular aspects of this invention (such as the second layer 125 or raised areas 155) may be created by typical forming processes, such as injection or compression molding. However, such processes may or may not yield the fine detail required for at least some aspects of the grip of the glove. Water jet cutting and chemical etching are alternative possible methods of manufacture (e.g., for forming the siping or other grooved areas). Laser cutting also may give a high level of sharpness and fine detail to the siping channels and/or other edges, and while all the above methods are applicable, laser cutting is a preferred method of manufacture. The glove structure itself may be formed by sewing or other conventional glove forming methods.

Conclusion

In conclusion, the gloves described in the above disclosure provide several benefits to the wearer. They enhance the gripping ability of the wearer by creating additional voids and edges in the second layer 125. Further, they increase the surface area of the second layer 125 to provide additional friction and improve catching ability. Also, the gloves prevent the hand from being inhibited in its movement. Additionally, the "feel" of the gloves is increased. Further, the "siping" grooves 140 and the channels 145 act to retain the enhanced gripping capability of the gloves by providing a "two-fold" system for moving water away from the contact areas 155 and the contact surface 130. Therefore, this "two-fold" system retains the already enhanced gripping ability of the gloves even when the gloves are used in wet conditions.

While the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

Alternatively, the glove may be constructed so that the palm side of the glove may be made from a single material, such as an elastomeric material, while the back side of the glove is made from a single, different material, such as fabric, leather, etc. The palm side and the back side may then be attached or adhered to each other in any known fashion, such as by stitching, etc. In this structure, the elastomeric material may be the only material of the palm side portion. Therefore, the elastomeric material would have both the siping grooves and the channels formed in the second layer. For example, the channels would merely be a thinned portion of elastomeric material while the raised contact areas would be merely a thicker portion.

Additionally, while described in detail in terms of use for football or soccer, those skilled in the art will appreciate that aspects of this invention may be used in a wide variety of athletic and other activities, including any activities in which gloves are worn, grip can be important, and/or damp or wet conditions may be experienced, such as golf, baseball, softball, rugby, hockey, rowing, tennis, gardening, fire-fighting, etc.

I claim:

1. A glove comprising:

a base layer of a flexible material that extends along at least a palm-side portion of the glove, wherein the base layer includes a palm area and inner sides of a plurality of finger stalls and a thumb stall; and a continuous second layer positioned on the palm-side portion and disposed on the base layer so that it continuously covers at least a majority of the base layer on the palm side portion of the glove, wherein the continuous second layer varies in thickness and includes:

a plurality of contact areas, wherein each contact area has a center and a peripheral edge; and a contact surface;

a plurality of siping grooves defined in the contact surface, wherein the siping grooves are configured to conduct liquid away from the contact surface of the contact areas, and a plurality of channels in which the continuous second layer is thinner than the contact areas, wherein the channels are configured to direct liquid away from the contact areas, wherein the contact areas of the second layer are raised and each contact area exhibits a curved sloped cross section that varies in thickness across its respective area such that the contact area is convex and slopes such that the center of the contact area has a greater thickness than the peripheral edge of the contact area, wherein the contact surface is the top of the raised contact areas, wherein a width of each of the channels is greater than a width of the siping grooves.

2. The glove according to claim 1, wherein the continuous second layer's contact areas are positioned at the finger stalls, thumb stall and palm area, and wherein the continuous second layer's channels are positioned at knuckle regions of the finger and thumb stalls including where the finger stalls meet the palm area and also extend through at least some portions of the palm area of the glove to thereby promote bending and flexibility of the glove.

3. The glove according to claim 1, wherein the siping grooves are disposed in the continuous second layer and a capillary action of the siping grooves draws liquid off the contact surface of the continuous second layer and conducts the liquid into the depth of the siping groove.

4. The glove according to claim 1, wherein the second layer is made from an elastomeric material.

5. The glove according to claim 1, wherein, in the contact areas, there is more contact surface than groove area.

6. The glove according to claim 1, wherein at least some of the siping grooves extend substantially continuously in a pattern in which the siping grooves are disposed to transport liquid away from the contact areas to edges of the glove.

7. The glove according to claim 6, wherein the pattern is a plurality of diamond shaped elements defining the substantially continuous siping grooves.

8. The glove according to claim 6, wherein the pattern is a plurality of overlapping angularly shaped elements defining the substantially continuous siping grooves.

9. The glove according to claim 6, wherein the pattern is a plurality of circular elements defining the substantially continuous siping grooves.

10. The glove according to claim 1, wherein the siping grooves include walls that extend substantially continuously from a first end of the siping groove to a second end of the siping groove, and further wherein the second layer includes a pattern in which the substantially continuous siping grooves are disposed to transport liquid away from the contact areas to edges of the glove.

11. The glove according to claim 10, wherein the pattern positions the substantially continuous siping grooves as a series of substantially sinusoidal lines extending toward the edges of the glove.

12. The glove according to claim 1, wherein the contact areas of the continuous second layer are raised with respect to the base layer, and wherein at least some of the siping grooves extend substantially continuously in a pattern through one of the raised contact areas to transport liquid away from the contact surface to an edge of the raised contact area.

13. A glove comprising:

a palm-side portion including a base layer; and a grip enhancing continuous layer disposed on the base layer, wherein the continuous layer includes:

raised contact areas positioned at a plurality of finger stalls, a thumb stall and a palm area, wherein each raised contact area has a center and a peripheral edge; and a contact surface;

a series of areas of less height which are defined by the raised contact areas and located at at least some bending areas of a wearer's hand; and a plurality of grooves defined in said the contact surface of the raised contact areas of said continuous layer, wherein said grooves are configured to remove liquid from a surface of the raised contact areas, and further wherein the areas of less height are configured to receive liquid from the grooves of the raised contact areas, wherein each raised contact area exhibits a curved sloped cross section that varies in thickness across its respective area such that the raised contact area is convex and slopes such that the center of the raised contact area has a greater thickness than the peripheral edge of the contact area, wherein the contact surface is the top of the raised contact areas, wherein a width of each of the areas of less height is greater than a width of the grooves.

14. The glove according to claim 13, wherein the grooves are disposed in the continuous layer and a capillary action of the grooves draws liquid off the continuous layer and conducts the liquid into the grooves.

15. The glove according to claim 14, wherein the grooves are configured in a pattern that is a plurality of diamond shaped elements.

16. The glove according to claim 14, wherein the grooves are configured in a pattern that is a plurality of overlapping angularly shaped elements.

17. The glove according to claim 13, wherein at least some of the grooves extend substantially continuously in a pattern through one of the raised contact areas to transport liquid away from the surface of the raised contact area to an edge of the raised contact area.

18. The glove according to claim 13, wherein at least some of the grooves extend through one of the raised contact areas to transport liquid away from the surface of the raised contact area to an edge of the raised contact area.

19. A glove comprising:

a palm-side portion including:

a grip enhancing elastomeric continuous layer, wherein the elastomeric continuous layer includes areas of tread positioned at a plurality of finger stalls, a thumb stall and a palm area wherein each area of tread has a center and a peripheral edge; and a contact surface; and areas without tread positioned at knuckle areas and within the palm area, wherein the areas of tread are thicker areas of elastomer and the areas without tread are thinner areas of elastomer, wherein the areas of tread include grooves disposed in the contact surface of the area of tread in continuous second layer and a capillary action of the grooves draws liquid off the contact surface of the continuous second layer and conducts the liquid into the depth of the groove, wherein each area of tread exhibits a curved sloped cross section that varies in thickness across its respective area such that the area of tread is convex and slopes such that the center of the area of tread has a greater thickness than the peripheral edge of the area of tread, wherein the contact surface is the top of the area of tread, wherein a width of each of the areas without tread is greater than a width of the grooves.

20. The glove according to claim 19, wherein the thinner areas of elastomer are located at areas of the glove corresponding to bending areas of a human hand.

21. The glove according to claim 19, wherein at least some of the grooves extend through one of the tread areas to transport liquid away from a surface of the tread area to an edge of the tread area.

22. The glove according to claim 19, wherein the palm side portion includes a textile material embedded within the elastomeric continuous layer.

* * * * *